United States Patent [19]

Tsuji

[11] 4,384,597

[45] May 24, 1983

[54] METHOD FOR SUPPLEMENTAL FLUID EJECTION ON A SHUTTLELESS LOOM AND AN AUXILIARY NOZZLE USED THEREFOR

[75] Inventor: Kanji Tsuji, Kanazawa, Japan

[73] Assignee: Tsudakoma Kogyo Kabushiki Kaisha, Japan

[21] Appl. No.: 235,422

[22] Filed: Feb. 17, 1981

[30] Foreign Application Priority Data

Feb. 18, 1980 [JP] Japan ..... 55-018552

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 3,124,167 3/1964 Te Strake ..... 139/435

FOREIGN PATENT DOCUMENTS 733791 5/1966 Canada ..... 139/435

2642734 4/1976 Fed. Rep. of Germany ..... 139/435

2454878 5/1976 Fed. Rep. of Germany ..... 139/435

*Primary Examiner*—Henry Jaudon

*Attorney, Agent, or Firm*—Lerner, David, Littenberg, Krumholz & Mentlik

[57] ABSTRACT

In a system to effect supplemental ejection of highly pressured operating fluid on a fluid-jet type shuttleless loom, the ejection terminal of each auxiliary nozzle is normally held at a stand-by position below and untouchable to the lower warp sheet of an open shed, but, only at the timing of the supplemental ejection, provisionally moved along a straight path of travel substantially parallel to the warp direction and substantially perpendicular to the lower warp sheet to an operating position in a specified area including the yarn guide channel in order to allow, on the one hand, correctly directed supplemental ejection in the close proximity of the advancing weft and, on the other hand, free and normal beating motion by the reed without any damage on the warps.

16 Claims, 8 Drawing Figures

METHOD FOR SUPPLEMENTAL FLUID EJECTION ON A SHUTTLELESS LOOM AND AN AUXILIARY NOZZLE USED THEREFOR

BACKGROUND OF THE INVENTION

The present invention relates to method for supplemental fluid ejection on a shuttleless loom and an auxiliary nozzle used therefor, and more particularly relates to an improved system for effecting successful and reliable supplemental fluid ejection on a fluid-jet type shuttleless loom such as an air-jet loom.

On the fluid-jet type shuttleless loom, each weft is transported along a course defined by a yarn guide channel in front of the reed whilst being entrained on a jet fluid ejected by a main nozzle located on one lateral side of the loom. Since the energy provided by the jet fluid ejected by the main nozzle is deficient for safely transporting the weft across the entire width of the open shed, in particular when the cloth to be woven is large in width, it is general to arrange a number of auxiliary nozzles at prescribed intervals along the advancing course of the weft. At phased timings, supplemental fluid ejection is carried out by these auxiliary nozzles in order to make up for the deficiency in weft transportation energy.

For sufficient addition of the weft transportation energy, such supplemental fluid ejection should be carried out in the close proximity of the advancing weft in a direction substantially parallel to the advancing direction of the weft. For this purpose, it is desirable to locate the fluid ejection terminal of each auxiliary nozzle as close as possible to the center of the yarn guide channel through which the weft advances.

Presence of the fluid ejection terminal of the auxiliary nozzle in the vicinity of the yarn guide channel, however, may hamper normal beating motion by the reed depending on the type of the warp line. Further, as later described in detail in reference to the drawings, warps are tend to be caught by the jaw of the yarn guide channel due to presence of the ejection terminal of the auxiliary nozzle in the open shed. This often eventuates in unsucessful shedding motion and yarn breakages.

Although various solutions have been proposed regarding this problem, neither of them were feasible without giving any malign influence on the weft transportation energy.

SUMMARY OF THE INVENTION

It is one object of the present invention to provide sufficient weft transportation energy on a jet-fluid type shuttleless loom by supplemental fluid ejection whilst allowing free and normal beating motion by the reed.

It is another object of the present invention to provide sufficient weft transportation energy on a jet-fluid type shuttleless loom with ideal shedding motion and minimized yarn breakages.

In accordance with the basic concept of the present invention, the ejection terminal of an auxiliary nozzle is kept at a stand-by position below and untouchable to the lower warp sheet of the open shed until the warps in the sheet pass by the jaw of the yarn guide channel, moved along a straight path of travel substantially parallel to the warp direction and substantially perpendicular to a lower warp sheet of an open shed to an operating position within a specified area including the yarn guide channel after the warps have passed by the jaw, and returned to the stand-by position after the supplemental ejection is over.

The term "a specified area" used herein refers to an area in which most of the fluid ejected by the ejection terminal in a substantially conical form enters the yarn guide channel to form a fluid stream for transporting the weft. The concrete dimension of such a specified area is fixed depending on the pressure of the fluid to be ejected, the diameter of the ejection terminal, and the inclination of the ejecting direction to the plane of the reed.

DESCRIPTION OF THE PREFERRED EMBODIMENTS

Figure 1A:
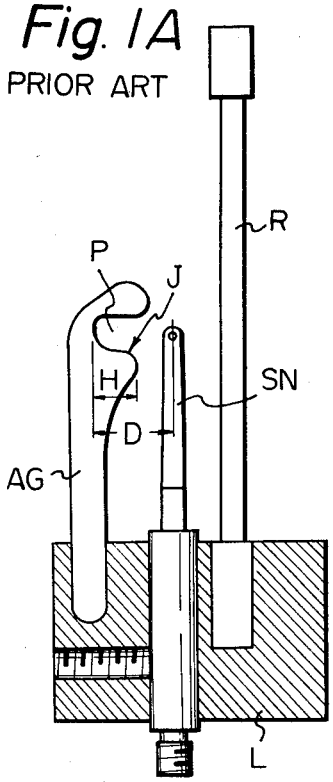
Fig. 1A PRIOR ART
FIGS. 1A and 1B are side views, partly in sections, of conventional auxiliary nozzles.

In the following description, parts used in different embodiments but substantially same in construction and function are designated with same reference numerals and symbols.

As described already, fluid ejection by each auxiliary nozzle should be carried out at a position as close as possible to a weft in transportation and in a direction as parallel as possible to the advancing direction of the weft, in order to obtain effective supplement of the transportation energy for the weft to be inserted. To this end, it is required to locate the fluid ejection mouth of the auxiliary nozzle as closely as possible to the center of the yarn guide channel for the weft.

Figure 1B:
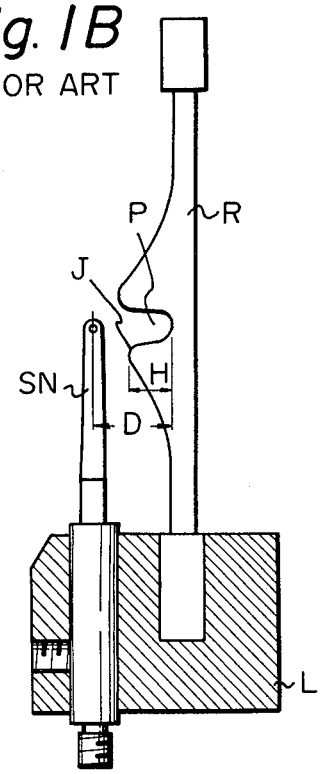
Fig. 1B PRIOR ART

Two different conventional arrangements for this purpose are shown in FIGS. 1A and 1B.

In the case of the arrangement shown in FIG. 1A, the yarn guide channel P is formed by air guides AG arranged on the lay L in front of the reed R. In this case, the fluid ejection mouth of the auxiliary nozzle SN in located slightly on the rear side of the center of the yarn guide channel P. In the case of the arrangement shown in FIG. 1B, the yarn guide channel P is formed by dents of the reed R and the fluid ejection mouth of the auxiliary nozzle SN is located slightly on the front side of the center of the yarn guide channel P.

In either case, the top end of the auxiliary nozzle SN is located closely in front of the reed R whilst being immovably mounted to the lay L. Consequently, depending on the type of the warp line on process, the top end of the auxiliary nozzle SN may impinge upon the cloth-fell during the beating motion of the loom, thereby disabling normal beating motion.

Figure 2:
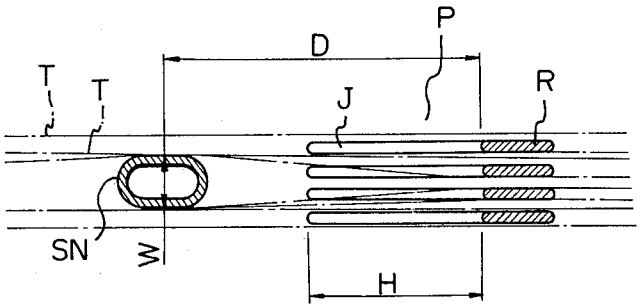
Fig. 2 PRIOR ART
FIG. 2 is a plane view, partly in section, of the auxiliary nozzle shown in FIG. 1B under a condition invading into the open shed whilst pushing on warps in the lower warp sheet.

Further, when the shed is open under the above-described condition, the top end of the auxiliary nozzle SN pushes on the warps T and passes by the jaw J of the yarn guide channel P. FIG. 2 illustrates the condition of the warps T just before the top end of the auxiliary nozzle SN passes by the jaw J on the arrangement shown in FIG. 1B.

Depending on the warp density, the warps T so pushed on curve sideways seriously in the vicinity of the reed R and tend to be caught by the jaw J of the yarn guide channel. This often causes ill shedding and/or warp breakage during weaving operation.

Such trouble may be obviated by minimizing the width W of the auxiliary nozzle, reducing the depth H of the yarn guide channel P, or enlarging the distance D between the auxiliary nozzle SN and the yarn guide channel P. These expedients, however, all lead to considerable lowering in transportation energy for the weft, and, therefore, are infeasible in commercial production. Even when any of the above-described expedients is employed, there should be a limit to change in design in order to maintain transportation energy for the weft on an appreciable level. This means these expedients cannot fully prevent occurance of the trouble in which the warps are caught by the jaw J of the yarn guide channel P.

For these reasons, the top end of the auxiliary nozzle has to be located at a lower position in front of the reed in the conventional arrangements. In other words, fluid ejection by the auxiliary nozzle has to be carried out at a position remote from the weft in transportation in a direction crossing the advancing direction of the weft in the conventional arrangement. This manner of fluid ejection naturally and apparently leads to poor utilization of the energy possessed by the ejected fluid for weft transportation.

Figure 3A:
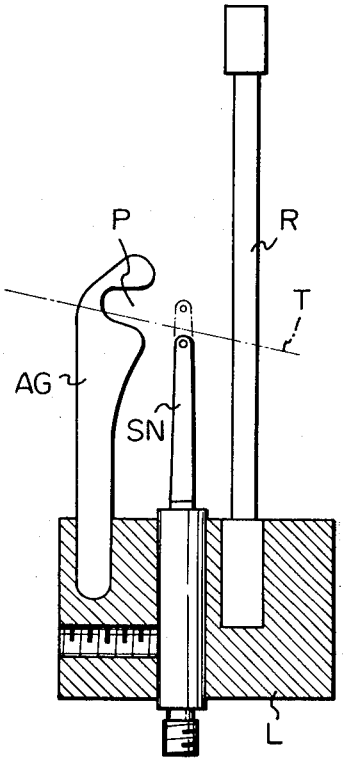
FIGS. 3A and 3B are side views, partly in section, showing operational principle of the auxiliary nozzle of the present invention.
Figure 3B:
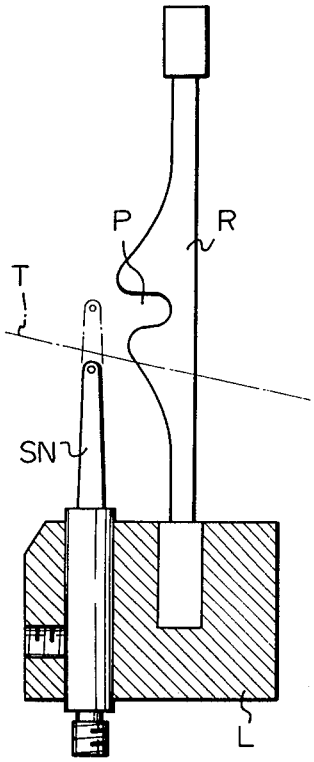

Operational principles of the auxiliary nozzle in accordance with the present invention are roughly shown in FIGS. 3A and 3B. In FIG. 3A, the present invention is applied to the arrangement shown in FIG. 1A. The fluid ejection mouth of an auxiliary nozzle SN is normally located at a position (a stand-by position) shown with solid lines and, at a prescribed timing, driven for movement to a higher position (an operating position) shown with chain lines, just on the rear side of the yarn guide channel formed by the air guide AG on the lay L. In FIG. 3B, the present invention is applied to the arrangement shown in FIG. 1B. The fluid ejection mouth of an auxiliary nozzle SN moves between positions shown with solid and chain lines, just on the front side of the yarn guide channel P formed by the reed R on the lay L.

Although the present invention is hereinafter described in relation to the second type arrangement only, it should be well understood that the present invention can well be applied to the first type arrangement with some modifications which are self-evident to those skilled in the art.

Figure 4A:
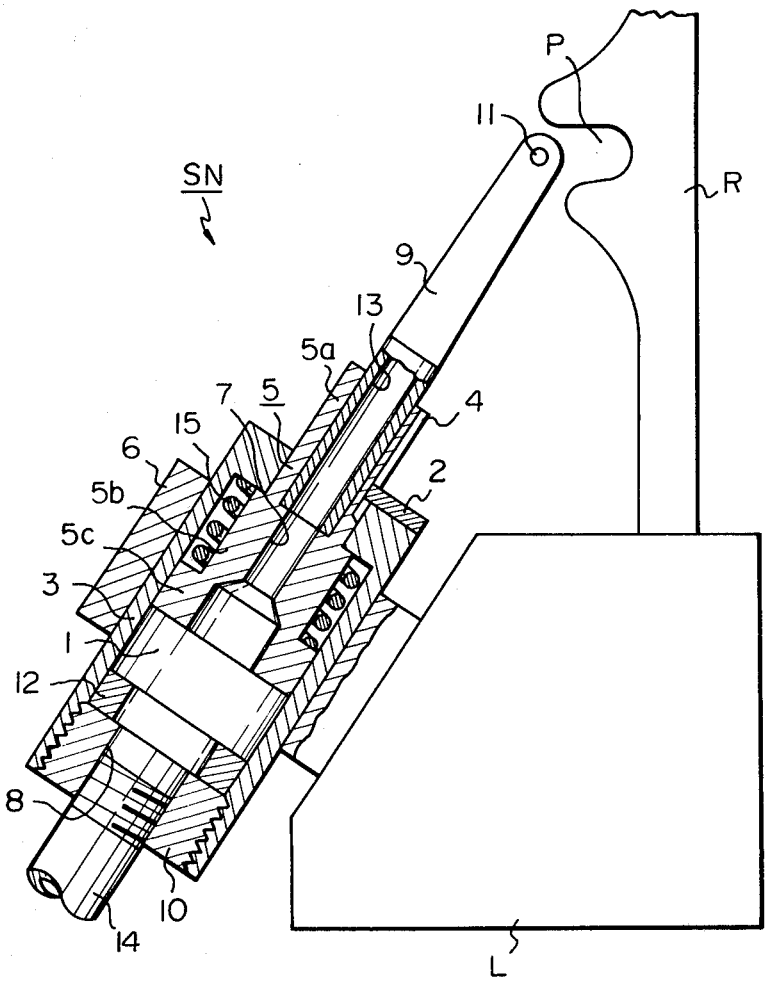
FIGS. 4A and 4B are side views, partly in section, of one embodiment of the auxiliary nozzle of the present invention.
Figure 4B:
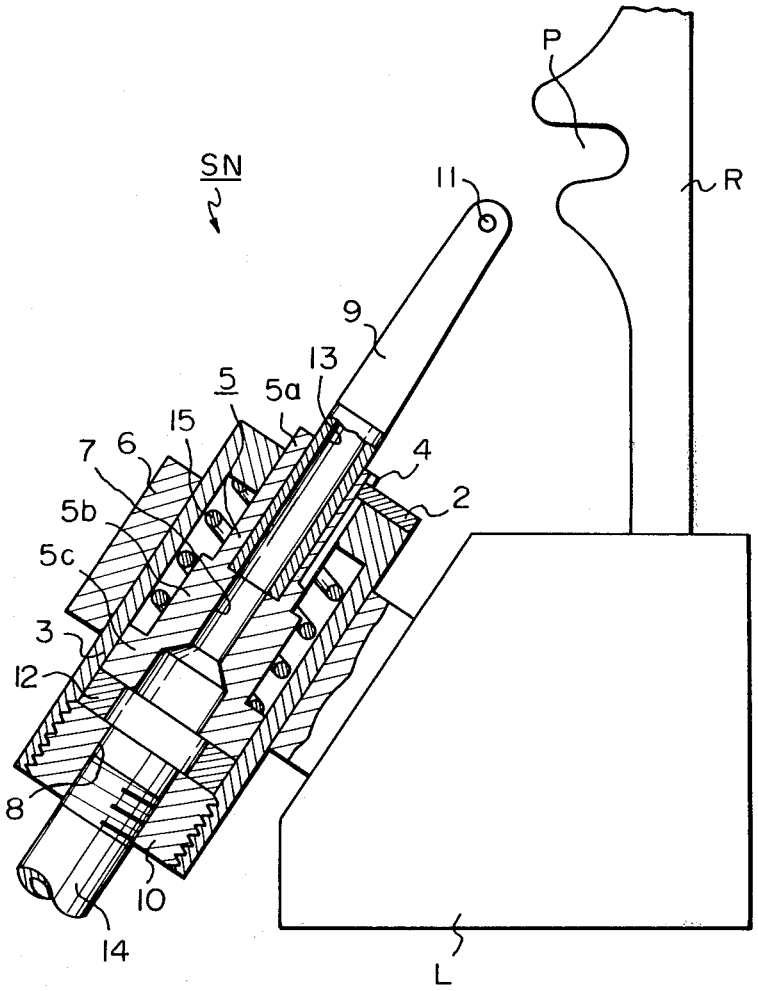

One embodiment of the auxiliary nozzle in accordance with the present invention is shown in FIGS. 4A and 4B, in which a nozzle head is driven for the movement by a single-acting piston mechanism.

More specifically, the auxiliary nozzle SN includes a cylindrical casing 3 fixed to the front face of the lay L of the loom with prescribed inclination by means of a bracket 6, whilst internally defining a piston chamber 1. The top end of the casing 3 is closed by an end wall having an axial bore and the lower end of the casing 3 is closed, by means of screw engagement, by an end closure 10 having an axial bore 8.

A plunger 5 is partly and axially slidably received in the casing 3. That is, the plunger 5 is made of a front section 5*a* of the smallest diameter, a middle section 5*b* of an intermediate diameter, and the rear section 5*c* of the largest diameter. The front section 5*a* extends slidably through the axial bore of the end wall of the casing 3 whereas the rear section 5*c* is slidably accommodated within the piston chamber 1. An axial bore 7 for passage of the fluid is formed through the plunger 5 with its rear end open in the piston chamber 1.

A nozzle head 9 is coaxially and fixedly held by the front section 5*a* of the plunger 5 and provided with an axial bore 13 for passage of the fluid. The rear end of this axial bore 13 in the nozzle head 9 is in direct communication with the axial bore 7 in the plunger 5 whereas the front end of the axial bore 13 forms a fluid ejection mouth 11 directed in parallel to the advancing direction of the weft.

A key 2 is fixed to the outside face of the end wall of the casing 3 in slidable engagement with a longitudinal groove 4 formed in the outer surface of the front section 5*a* of the plunger 5 in order to prevent axial rotation of the plunger 5 during the reciprocal movement. A helical compression spring 15 is interposed, within casing 3, between the front end wall of the casing 3 and a step formed at the border between the middle and rear sections 5*b* and 5*c* of the plunger 5 whilst encompassing the middle section 5*b*. A cushion ring 12 is attached within the piston chamber 1 to the end closure 10. A conduit 14 connected to a given supply source of the pressured operating fluid is screwed into the axial bore 8 of the end closure 10 for supply of the operating fluid. More preferably, the supply conduit 14 is connected to the supply source of the pressure operating fluid used for the main shaft. The conduit 14 should be designed so that the flow rate of the fluid through the conduit 14 should be by far larger than that through the fluid ejection mouth 11.

The entire construction and arrangement of the auxiliary nozzle SN should be designed so that the fluid ejection mouth 11 should be located, in the operating position shown in FIG. 4A, at a position just in front of the center of the yarn guide channel P of the reed R whereas the top end of the nozzle head 9 is located, in the stand-by position shown in FIG. 4B, at a position out of contact with the lower warp sheet of the open shed.

The auxiliary nozzle SN with the above-described construction operates as follows. Before the supplemental fluid ejection, the auxiliary nozzle SN rests at the stand-by position shown in FIG. 4B. That is, repulsion of the spring 15 keep the plunger 5 at its most receded position in contact with the cushion ring 12 so that the top end of the nozzle head 9 is located below the lower warp sheet of the open shed without any contact with the warp in the sheet.

At the timing the warps T pass by the jaw J of the yarn guide channel P in the reed R, a valve is opened in the system between the supply source of the operating fluid and the auxiliary nozzle SN in response to a signal which is generated, for example, by a timing cam operationally related to running of the loom. Consequently, the fluid is introduced into the auxiliary nozzle SN via the conduit 14 in order to be ejected via the fluid ejection mouth 11 of the nozzle head 19. Due to the difference in amount between the input and output of the fluid, the piston chamber 1 is instantly filled with the highly pressurized fluid and the high pressure prevailing in the piston chamber 1 urges the plunger 5 to move forwards against the repulsion of the spring 15. As a consequence, the nozzle head 9 advances towards the reed R in order to bring its ejection mouth 11 to a position just in front of the center of the yarn guide channel P as shown in FIG. 4A.

At a prescribed timing, the above-described valve is automatically closed in order to discontinue supply of the operating fluid to the auxiliary nozzle SN but the ejection decays gradually due to presence of the operating fluid in the piston chamber 1. This continued ejection of the operating fluid gradually lowers the pressure prevailing in the piston chamber 1. When the pressure falls short of the repulsion of the spring 15, the plunger 5 is urged to move rearwards in order to resume the stand-by position shown in FIG. 4B, in which the top end of the nozzle head 9 is located below the lower warp sheet of the open shed so as not to disturb the subsequent normal beating motion by the reed R.

Figure 5:
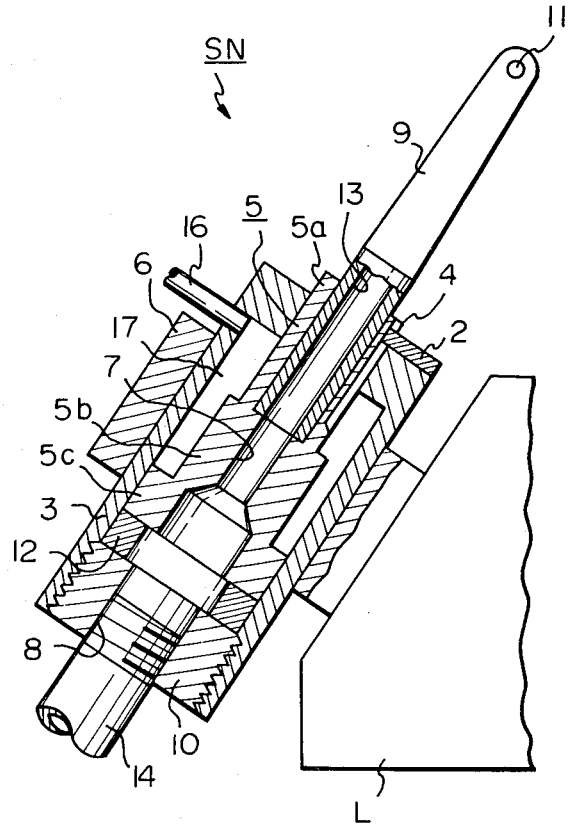
FIG. 5 is a side view, partly in section, of another embodiment of the auxiliary nozzle of the present invention.

Another embodiment of the auxiliary nozzle in accordance with the present invention is shown in FIG. 5, in which the operation is controlled by a double-acting piston mechanism. This auxiliary nozzle SN differs from the first one in that it does not include the compression spring 15. As a substitute, a conduit 16 connected, via a suitable valve, to a given supply source of pressured fluid opens in a cylindrical space 17 around the front and middle sections 5*a* and 5*b* of the plunger 5. The second conduit 16 may be connected to the supply source used for the first conduit 14.

This auxiliary nozzle SN operates as follows. First, the operating fluid is introduced into the auxiliary nozzle SN via the first conduit 14 and ejected in a manner same as in the first embodiment. During the supplementally ejection, the auxiliary nozzle SN assumes the position shown in FIG. 5.

At the prescribed timing, supply of the operating fluid is stopped at the first conduit 14 and, simultaneously, started at the second conduit 16. Consequently, the pressure in the piston chamber 1 lowers gradually due to the continued ejection whereas the pressure in the cylindrical space 17 rises gradually due to the started supply via the second conduit 16. When the pressure in the cylindrical space 17 exceeds that in the piston chamber 1, the difference in pressure urges the plunger 5 rearwards so that the top end of the nozzle head 9 is brought below the lower warp sheet of the open shed for the sake of the subsequent beating motion.

Figure 6:
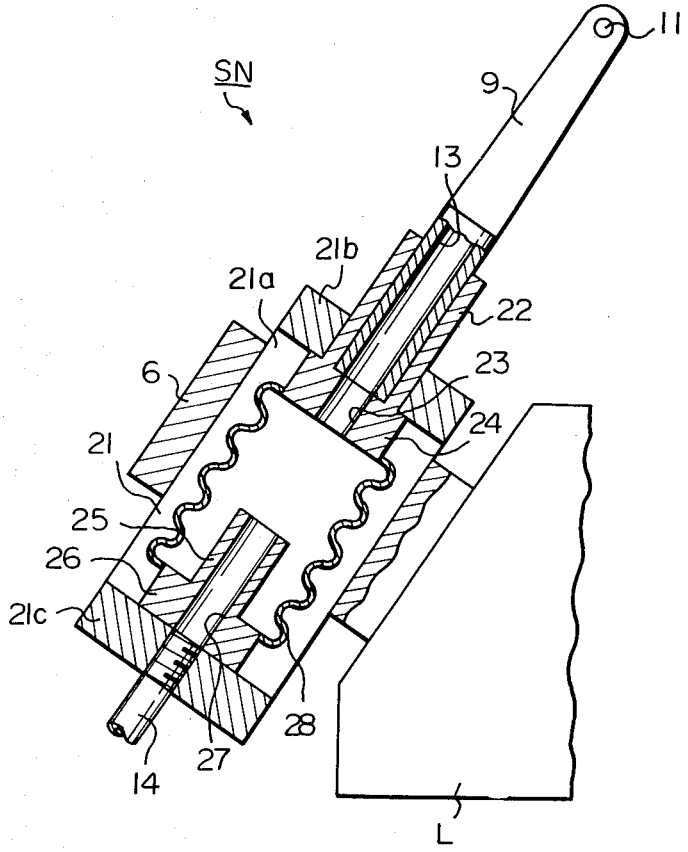
FIGS. 6 to 8 are side views, partly in section, of the other embodiments of the auxiliary nozzle of the present invention.

The other embodiment of the present invention is shown in FIG. 6, in which a bellows is used for controlling the operation of the auxiliary nozzle SN. More specifically, the auxiliary nozzle SN includes a channel type holder 21 fixed to the front face of the lathe L with prescribed inclination by means of a bracket 6 attached to its body 21*a*. A front branch 21*b* of the holder 21 slidably carries a plunger 22 having an axial bore 23 for passage of the operating fluid, and other flange 24. A piston head 9 having a fluid ejection mouth 11 is fixed to the front end of the plunger 22 with its axial bore 13 in communication with the bore 23 in the plunger 22.

The rear branch 21*c* of the holder 21 fixedly holds a bellows holder 25 having an outer flange 26 and an axial bore 27 substantially in axial alignment with the bore 23 in the plunger 22. A conduit 14 connected to a given supply source of the highly pressurized operating fluid is coupled to the rear branch 21*c* in communication with the bore 27 in the bellows holder 25. A bellows 28 is fixed at both ends to the outer flanges 24 and 26 of the plunger 22 and the bellows holder 25.

When the auxiliary nozzle SN is at the stand-by position, the plunger 22 is located, due to longitudinal shrinkage of the bellows 28, at the most receded position with its rear end in abutment against the front end of the bellows holder 25, and the top end of the nozzle head 9 is located below the lower warp sheet of the open shed.

At the timing of the supplemental ejection, the operating fluid is admitted into the bellows 28 and ejected via the ejection mouth 11. Like in the foregoing embodiments, the bellows 28 is filled with the operating fluid and the pressure within the bellows 28 rises instantly. As the pressure exceeds the shrinking force of the bellows 28, the pressure forces the plunger 22 to move forwards whilst stretching the bellows 28. This forward movement ends when the outer flange 24 of the plunger 22 abuts against the front branch 21*b* of the holder 21 and the fluid ejection mouth 11 is registered at the correct position in the vicinity of the yarn guide channel P as shown in FIG. 6.

At the prescribed timing, supply of the pressured fluid is stopped and the pressure within the bellows 28 decays gradually due to the continued ejection via the mouth 11. As the pressure within the bellows 28 falls short of the shrinking force of the bellows 28, shirinkage of the bellows 28 causes rearward movement of the plunger 22, which lasts until its rear end abuts against the front end of the bellows holder 25. Thereupon, the top end of the nozzle head 9 is brought to the position below the lower warp sheet of the open shed in order to allow normal beating motion by the reed.

In the above-described construction, the distance between the front end of the bellows holder 25 and the rear end of the plunger 22 in the most advanced position should be equal to that between the operating and stand-by positions of the fluid ejection mouth 11. In the case of this embodiment, there is no need to use the locking mechanism by the groove 4 and the key 2 since presence of the bellows 28 by itself well hinders possible rotation of the plunger 22 during the reciprocation.

In the case of the foregoing three embodiments, highly pressured operating fluid is used for controlling the operation of the auxiliary nozzle. In accordance with the present invention, however, such a control may also be carried out mechanically as in the further embodiments shown in FIGS. 7 and 8.

Figure 7:
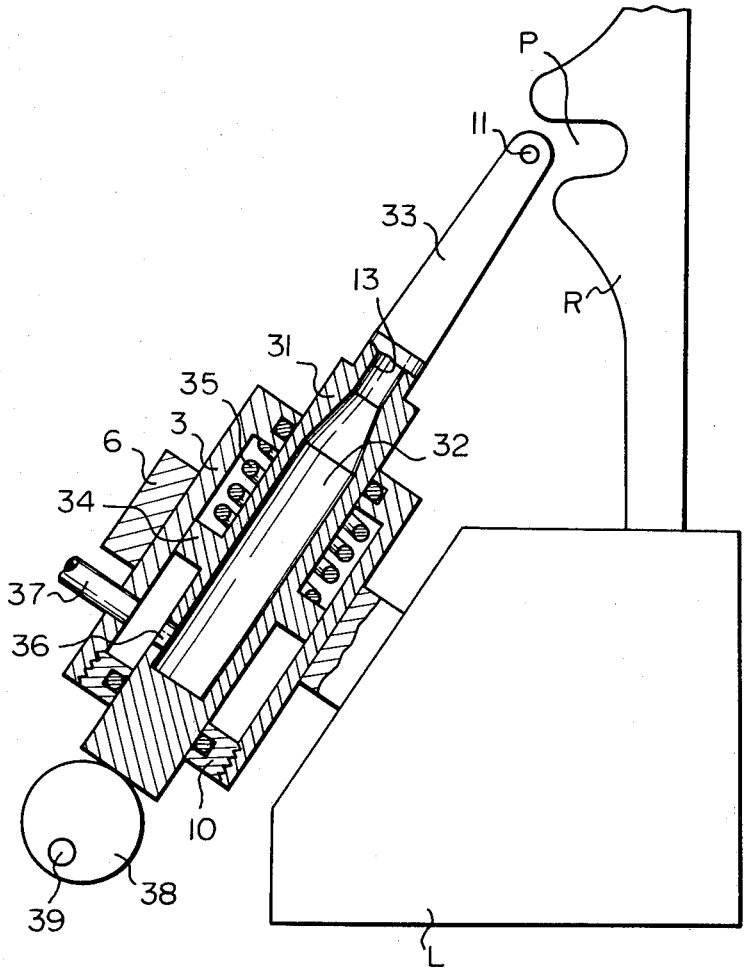

In FIG. 7, the auxiliary nozzle SN of this type includes a cylindrical casing 3 fixed to the front face of the lathe L by means of a bracket 6. The front end of the casing 3 is closed by an end wall having an axial bore and the rear end is closed by an end closure 10 having an axial bore. A plunger 31 extends slidably through these axial bores and internally defines a fluid chamber 32. A nozzle head 33 is formed monolithically with the plunger 31 whilst extending forwards. This nozzle head 33 is provided at its top end with a fluid ejection mouth 11, and internally with an axial bore 13 which connects the fluid chamber 32 to the mouth 11.

The plunger 31 is provided with an outer flange 34 which operates as a seat for a helical compression spring 35 abutting at the other end against the end wall of the casing 3. A radial bore 36 is formed through the plunger 31 in order to connect the fluid chamber 32 to a cylindrical space in the casing 3 around the plunger 31. A conduit 37 connected, via a suitable valve, to a given supply source of highly pressurized fluid opens in the above-described cylindrical space. The tail end of the plunger 31 is in resilient pressure contact, due to the spring repulsion, with a cam 38 secured on a rotary shaft 39. This shaft 39 is driven for rotation in synchronism with the main shaft of the loom and rotates once per each rotation of the main shaft. This shaft 39 is preferably used commonly for all auxiliary nozzles on the loom with difference in phase angle of the associated cams.

Normally, the small diametral section of the cam 38 is in contact with the tail end of the plunger 31 and the plunger 31 is located at its most receded position whilst being pressed by the spring 35. Consequently, the ejection mouth 11 is registered as the stand-by position below the lower warp sheet of the open shed in order to allow normal beating motion.

At the prescribed timing, the large diametral section of the cam 38 comes in contact with the tail end of the plunger 31 and the plunger 31 is located at its most advanced position so that the ejection mouth 11 is located at the operating position just in front of the center of the yarn guide channel P. Consequently with this, supply of the operating fluid is initiated.

In the case of the foregoing embodiments, the auxiliary nozzle SN is connected to the supply source of the highly pressured operating fluid by means of the conduit accompanied with the valve with controls supply of the operating fluid. The auxiliary nozzle SN is forced to move with the lay L as the latter sways for beating motion, since the auxiliary nozzle SN is fixed to the lay L. In order to allow smooth movement of this sort of the auxiliary nozzle SN, it is necessary to make the distance between the above-described control valve and the distal end, i.e. the junction to the auxiliary nozzle SN, of the conduit sufficiently large. This long path of flow tends to cause a time lag in initiation of the supplemental ejection by the auxiliary nozzle SN, and pressure loss of the operating fluid due to the increased flow resistance of the conduit. In particular, the latter results in poor weft transportation energy during the starting period of the supplemental fluid ejection.

In order to obviate these troubles, supply control of the operating fluid should be carried out at a position as close as possible to the auxiliary nozzle SN but without hampering the movement of the auxiliary nozzle SN with the lay L. The embodiment shown in FIG. 8 well suffices this contradictory requirement, in which supply of the operating fluid is controlled by the operation of the auxiliary nozzle SN itself.

More specifically, the auxiliary nozzle SN includes a plunger 41 slidably encased within a cylindrical casing 3 and having a tail section slidably extending rearwards through the axial bore of an end closure 10. The tail end of the plunger 41 is in resilient pressure contact with a cam 38 on a rotary shaft 39. A compression spring 35 is interposed between the front end of the plunger 41 and the end wall of the casing 3. A radial bore 36 is formed through the plunger 41 whilst opening in a fluid chamber 32 formed in the plunger 41. A nozzle head 33 is formed monolithically with the plunger 41 whilst slidably extending forwards through an axial bore of the end wall of the casing 3. An axial bore 13 is formed in the nozzle head 33 opening in the fluid chamber 32 within the plunger 41. This axial bore 13 terminates in a fluid ejection mouth 11 formed in the top end of the nozzle head 33. A conduit 42 connected to a given supply source of highly pressurized operating fluid is coupled to the casing 3 whilst opening in the interior of the casing 3.

This conduit 42 is coupled to the casing 3 such that its opening meets the radial bore 36 in the plunger 41 only when the tail end of the plunger 41 is in contact with the large diametral section of the cam 38. In other words, the operating fluid from the supply source is admitted into the fluid chamber 32 in the plunger 41 via the radial bore 36 only when the tail end of the plunger 41 is in contact with the large diametral section of the cam 38. During other period, the operating fluid, which has reached the distal end of the conduit 42, isn't allowed to flow into the fluid chamber 32 since the opening of the conduit 42 is closed by the outer surface of the plunger 41.

Figure 8:
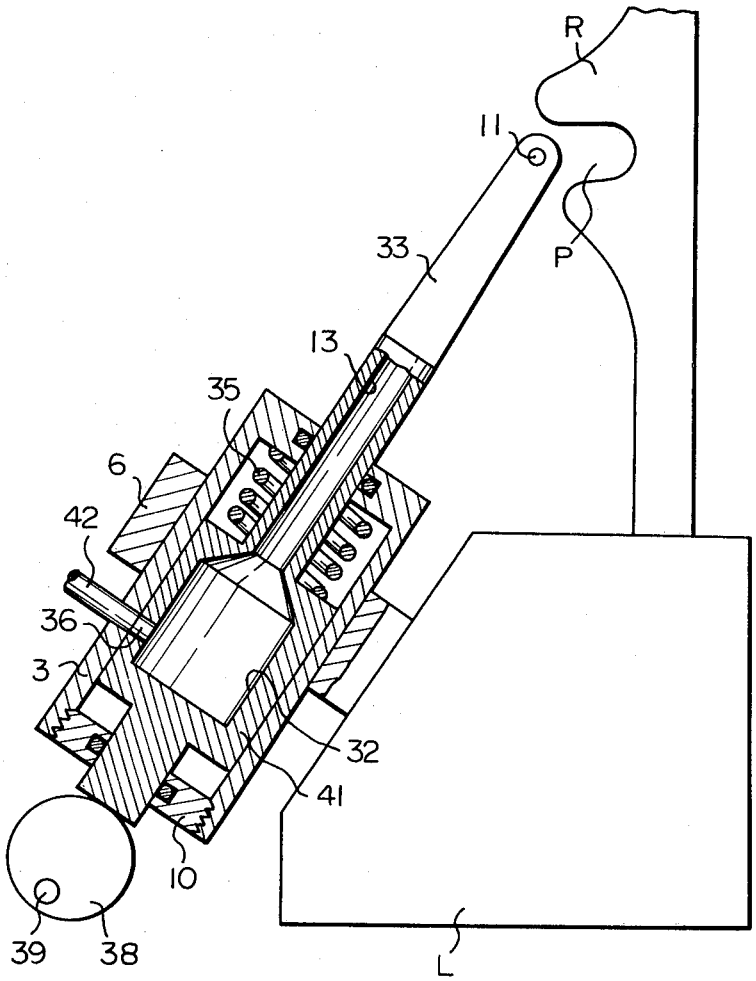

Normally, the small diametral section of the cam 38 is in contact with the tail end of the plunger 41, which is located at the most receded position off the one shown in FIG. 8 due to the spring repulsion. Consequently, the opening of the conduit 42 is closed by the outer surface of the plunger 41 so that no operating fluid is admitted into the fluid chamber 32 in the plunger 41. The fluid ejection mouth 11 is kept at the stand-by position below the lower warp sheet of the open shed in order to enable normal beating motion.

At the prescribed timing, the large diametral section of the cam 38 comes in contact with the tail end of the plunger 41, which is registered at the most advanced position in the casing 3 so that the fluid ejection mouth 11 is brought to the operating position just in front of the center of the yarn guide channel P. Concurrently, the opening of the conduit 42 meets the radial bore 36 in the plunger 41 to allow introduction of the operating fluid into the fluid chamber 32 for supplemental ejection.

In the case of this embodiment, the extremely short path of flow of the operating fluid at the starting of the supplemental ejection well cuts down the pressure loss and time lag.

In accordance with the present invention, the fluid ejection mouth of the auxiliary nozzle is located very close to the weft in transportation at the very moment of supplemental ejection in order to provide as large as possible transportation energy to the weft, thereby attaining reliable and successful weft insertion. Further, since the fluid ejection mouth is normally kept at the standby position below the lower warp sheet of the open shed in order to minimize the stay of the fluid ejection mouth in the open shed, thereby assuring normal beating motion and less breakages of the warps which are otherwise caused by engagement with the jaw of the yarn guide channel.

The arrangements shown in FIGS. 7 and 8 may further contain a locking mechanism same as the one used for the first embodiment in order to prevent axial rotation of the plunger during the reciprocation.

I claim:

1. Method for supplemental fluid ejection on a shuttleless loom comprising keeping an ejection terminal of an auxiliary nozzle at a stand-by position below and out of contact with a lower warp sheet of an open shed until warps in said lower warp sheet pass by a jaw of a yarn guide channel of said loom, moving said ejection terminal generally upward into said open shed through said lower warp sheet along a straight path of travel substantially parallel to the warp direction and substantially perpendicular to said lower warp sheet to an operating position within a specified area in the vicinity of said yarn guide channel after said warps in said lower warp sheet have passed by said jaw of said yarn guide channel, carrying out supplemental fluid ejection through said ejection terminal, and returning said ejection terminal along said straight path of travel to said stand-by position after said supplemental ejection is over.

2. Method for supplemental fluid ejection as claimed in claim 1 in which said ejection terminal of said auxiliary nozzle is driven for movement by operation of highly pressurized fluid.

3. Method for supplemental fluid ejection as claimed in claim 2 in which said highly pressurized fluid is taken from a supply source of fluid for a main nozzle of said loom.

4. An auxiliary nozzle for a shuttleless loom comprising a substantially straight nozzle head having a fluid ejection mouth formed in an ejection terminal thereof and directed substantially towards a weft advancing direction, means for mounting said nozzle head to a lay of said loom such that said nozzle head is longitudinally slidable along a straight path of travel substantially parallel to the warp direction and substantially perpendicular to a lower warp sheet of an open shed, means for supplying high pressure fluid to said auxiliary nozzle at least at the moment of supplemental fluid ejection through said fluid ejection mouth of said nozzle head, means for driving said nozzle head for reciprocal movement along said path of travel between a receded position in which said ejection terminal is in a stand-by position below and out of contact with said lower warp sheet until warps in said lower warp sheet pass by a jaw of a yarn guide channel of said loom and an advanced position in which said ejection terminal is located in said open shed at an operating position within a specified area in the vicinity of said yarn guide channel after said warps in said lower warp sheet have passed by said jaw of said yarn guide channel.

5. An auxiliary nozzle as claimed in claim 4 in which said driving means includes a piston mechanism operated by highly pressurized fluid.

6. An auxiliary nozzle as claimed in claim 5 in which said piston mechanism is a single-acting piston.

7. An auxiliary nozzle as claimed in claim 6 in which said mounting means include a cylindrical casing closed at both longitudinal ends in order to define a piston chamber, and a bracket coupling said casing to the lay of said loom, said supplying means include a given supply source of said highly pressurized fluid, a conduit connected to said supply source and opening in said piston chamber of said casing, and a supply control valve attached to said conduit, and said driving means includes a plunger having a front of a smallest diameter slidably extending through a front end of said casing and holding said nozzle head, a middle section of an intermediate diameter, and a rear section of a largest diameter slidably encased within said piston chamber of said casing, and an axial bore formed through said sections in communication with said piston chamber and said fluid ejection mouth of said nozzle head; and a compression spring interposed between said front end of said casing and a step formed at the border between said middle and rear sections of said plunger.

8. An auxiliary nozzle as claimed in claim 5 in which said piston mechanism is a double-acting piston.

9. An auxiliary nozzle as claimed in claim 8 in which said mounting means include a cylindrical casing closed at both longitudinal ends in order to define a piston chamber, and a bracket coupling said casing to the lay of said loom, said supply means include a given supply source of said highly pressurized fluid, a first conduit connected to said supply source and opening in said piston chamber of said casing, and a supply control valve attached to said first conduit, and said driving means include a plunger having a front section of a smallest section slidably extending through a front end of said casing and holding said nozzle head, a middle section of an intermediate diameter, a rear section of a largest diameter slidably encased within said piston chamber of said casing, and an axial bore formed through said sections in communication with said piston chamber and said ejection bore of said nozzle; a second conduit connected to said supply source of said highly pressured fluid and opening in a cylindrical space in said casing around said front and middle sections of said plunger; and a supply control valve attached to said second conduit.

10. An auxiliary nozzle as claimed in claim 4 in which said driving means include a bellows mechanism operated by highly pressurized fluid.

11. An auxiliary nozzle as claimed in claim 10 in which said mounting means include a holder having front and rear branches spaced from each other, and a bracket coupling said holder to the lay of said loom, said supply means include a given supply source of said highly pressurized fluid, a conduit connected to said supply source and coupled to said rear-branch of said holder, and a supply control valve attached to said conduit, and said driving means include a plunger slidably extending through said front branch of said holder, holding said nozzle head and having an outer flange on the rear side of said front branch and an axial bore in communication with said fluid ejection mouth of said nozzle head; a bellows holder fixed to said rear branch of said holder and having an axial bore in communication with said conduit; and a bellows coupled at both longitudinal ends to said plunger and said bellows holder.

12. An auxiliary nozzle as claimed in claim 4 in which said driving means include a cam mechanism operated in synchronism with rotation of a main shaft of said loom.

13. An auxiliary nozzle as claimed in claim 12 in which said mounting means include a cylindrical casing closed at both longitudinal ends, and a bracket coupling said casing to the lay of said loom, said supply means include a given supply source of said highly pressurized fluid, a conduit connected to said supply source and opening in the interior of said casing, and a supply control valve attached to said conduit, and said driving means include a plunger extending rearwards monolithically from said nozzle head through said casing and having an outer flange slidably encased within said casing, a fluid chamber in communication with said fluid ejection mouth of said nozzle head and said interior of said casing; a compression spring interposed between said outer flange of said plunger and said front end of said casing; a shaft driven for rotation in synchronism with said main shaft of said loom; and a cam mounted on said shaft in pressure contact with the tail end of said plunger outside said casing.

14. An auxiliary nozzle as claimed in claim 12 in which said mounting means include a cylindrical casing closed at both longitudinal ends, and a bracket coupling said casing to the lay of said loom, said supply means include a given supply source of said highly pressurized fluid, and a conduit connected to said supply source and opening in the interior of said casing, and said driving means include a plunger extending rearwards monolithically from said nozzle head, which extends slidably through said front end of said casing, and having a body slidably encased within said casing, a fluid chamber formed in said body in communication with said fluid ejection mouth of said nozzle head, a radial bore opening in said fluid chamber, and a rear section slidably extending through said rear end of said casing; a compression spring interposed between said body of said plunger and said front end of said casing; a shaft driven for rotation in synchronism with said main shaft of said loom; and a cam mounted on said shaft in pressure contact with the tail end of said plunger outside said casing;

said radial bore of said plunger communicates with the opening of said conduit only when said plunger is at its most receded position.

15. An auxiliary nozzle as claimed in claim 7, 9, 13 or 14 further comprising means for locking said plunger against axial rotation during said reciprocal movement.

16. An auxiliary nozzle as claimed in claim 15 in which said locking means include a longitudinal groove formed in the outer surface of said plunger or said nozzle head, and a key fixed to the front end of said casing in slidable engagement with said longitudinal groove.

* * * * *